US005169552A

United States Patent [19]

Wise

[11] Patent Number: 5,169,552

[45] Date of Patent: Dec. 8, 1992

[54] STABLE THICKENED LIQUID CLEANING COMPOSITION CONTAINING BLEACH

[75] Inventor: Rodney M. Wise, Cincinnati, Ohio

[73] Assignee: The Procter & Gamble Company, Cincinnati, Ohio

[21] Appl. No.: 708,826

[22] Filed: May 29, 1991

Related U.S. Application Data

[63] Continuation of Ser. No. 417,123, Oct. 4, 1989, abandoned.

[51] Int. Cl.[5] ..... C11D 1/00

[52] U.S. Cl. ..... 252/95; 252/99; 252/103; 252/174.23; 252/174.24; 252/DIG. 14; 252/DIG. 2

[58] Field of Search ..... 252/95, 99, 103, 174.23, 252/174.24, DIG. 14, DIG. 2

[56] References Cited

U.S. PATENT DOCUMENTS

| | | | |
|---|---|---|---|
| 3,671,440 | 6/1972 | Sabatelli et al. | 252/103 |
| 3,932,316 | 1/1976 | Sagel et al. | 252/532 |
| 4,147,650 | 4/1979 | Sabatelli et al. | 252/103 |
| 4,333,862 | 6/1982 | Smith et al. | 252/547 |
| 4,431,559 | 2/1984 | Ulrich | 252/99 |
| 4,576,728 | 3/1986 | Stoddard | 252/102 |
| 4,740,327 | 4/1988 | Julemont et al. | 252/103 |
| 4,800,036 | 1/1989 | Rose et al. | 252/102 |
| 4,810,409 | 3/1989 | Harrison et al. | 252/102 |
| 4,810,413 | 3/1989 | Pancheri et al. | 252/174.12 |
| 4,836,946 | 6/1989 | Dixit | 252/97 |
| 4,836,948 | 6/1989 | Corring | 252/99 |
| 4,839,077 | 6/1989 | Cramer et al. | 252/98 |
| 4,859,358 | 8/1989 | Gabriel et al. | 252/99 |
| 4,867,896 | 9/1989 | Elliott et al. | 252/94 |
| 4,900,467 | 2/1990 | Smith | 252/95 |

FOREIGN PATENT DOCUMENTS

| | | |
|---|---|---|
| 264975 | 4/1988 | European Pat. Off. . |
| 0295093A1 | 12/1988 | European Pat. Off. . |
| 295093 | 12/1988 | European Pat. Off. . |
| 317066 | 5/1989 | European Pat. Off. . |
| 2116199A | 9/1983 | United Kingdom . |
| 2140450A | 11/1984 | United Kingdom . |
| 2203163 | 10/1989 | United Kingdom . |

OTHER PUBLICATIONS

Y. Ogata and K. Iomizawa, "Photoreaction of Benzoic Acid with Sodium Hypochlorite in Aqueous Alkali", pp. 986-988, Royal Society of Chemistry, Cambridge, England, 1984.

M. Santrucek and J. Krepelka, "Antioxidants-Potential Chemotherapeutic Agents", pp. 973-996, Drugs of the Future, vol. 13, No. 10, 1988.

*Primary Examiner*—Paul Lieberman
*Assistant Examiner*—M. Dinunzio
*Attorney, Agent, or Firm*—Mary P. McMahon; Fernando A. Borrego; Kathleen M. Harleston

[57] ABSTRACT

Liquid cleaning compositions displaying enhanced physical stability in the presence of bleach are provided, comprising a chlorine bleach ingredient, cross-linked polycarboxylate polymer, a rheology stabilizing agent, and a buffering agent to maintain the pH of the composition above about 10. Preferred liquid automatic dishwashing detergent compositions containing builder and optional surfactant and metalate, and displaying shear thinning behavior, are disclosed.

33 Claims, No Drawings

STABLE THICKENED LIQUID CLEANING COMPOSITION CONTAINING BLEACH

This is a continuation of application Ser. No. 417,123, filed on Oct. 4, 1989, now abandoned.

TECHNICAL FIELD

This invention relates to liquid cleaning compositions incorporating a chlorine bleach ingredient, cross-liked polycarboxylate polymers, a rheology stabilizing agent, and a buffering agent, and which display enhanced physical stability in the presence of bleach. On particular application relates to a liquid automatic dishwashing detergent composition additionally containing builder and optimal surfactant and metalate, and exhibiting shear thinning behavior, i.e., high viscosity at low rates off shear and lower viscosities at high rates of shear.

BACKGROUND OF THE INVENTION

Thickened aqueous cleaning compositions are known, having been taught in U.S. Pat. Nos. 3,843,548; 3,558,496; 3,684,722; 4,005,027; and 4,116,851.

The use of bleaches in cleaning housewares is known, having been taught in U.S. Pat. Nos. 3,928,065; 3,708,429; 3,058,917; and 3,671,440.

The use of polycarboxylate polymers in cleaning compositions is known, as disclosed in U.S. Pat. Nos. 3,060,124; 3,671,440; 4,392,977; 4,147,650; and 4,836,948; U.K. Pat. No. 1527706; and U.K. Pat. Application No. 2203163A.

The use of benzoic acid or salt or derivative thereof in cleaning compositions is known, as taught in U.S. Pat. Nos. 4,810,409; 4,810,413; 4,576,728; 3,932,316; and 4,333,862.

However, none of the above patents discloses applicant's compositions containing a cross-linked polycarboxylate polymer, a chlorine bleach ingredient, a rheology stabilizer, and a buffering agent.

SUMMARY OF THE INVENTION

The compositions of this invention ar liquid cleaning compositions comprising, by weight;

(a) a chlorine bleach ingredient providing from about 0.2% to about 2.5% available chlorine;

(b) from about 0.1% to about 10% of a cross-linked polycarboxylate polymer thickening agent;

(c) from about 0.05% to about 5% of a rheology stabilizing agent having the formula

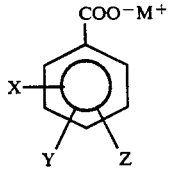

wherein each X, Y, and Z is —H, —COO⁻M⁺, —Cl, —Br, —$SO_3^-M^+$, —$NO_2$, —$OCH_3$, or a $C_1$ to $C_4$ alkyl and M is H or an alkali metal; or mixtures thereof; and (d) sufficient alkalinity buffering agent to provide said composition with a pH greater than about 10.

A particularly preferred embodiment of this invention is a liquid automatic dishwashing detergent composition further comprising:

(a) from 0% to about 5% of a detergent surfactant;

(b) from about 5% to about 50% of a detergency builder material; and (c) from 0% to about 1% of an alkali metal salt of an amphoteric metal anion.

DETAILED DESCRIPTION OF THE INVENTION

The compositions of the present invention comprise four essential ingredients: a chlorine bleach ingredient, a cross-linked polycarboxylate polymer thickening agent, a rheology stabilizing agent, and an alkalinity buffering agent.

Chlorine Bleach Ingredient

The instant compositions include a bleach ingredient which yields a hypochlorite species in aqueous solution. The hypochlorite ion is chemically represented by the formula $OCl^-$. The hypochlorite ion is a strong oxidizing agent, and materials which yield this species are considered to be powerful bleaching agents.

The strength of an aqueous solution containing hypochlorite ion is measured in terms of available chlorine. This is the oxidizing power of the solution measure by the ability of the solution to liberate iodine from an acidified iodide solution. One hypochlorite ion has the oxidizing power of 2 atoms of chlorine, i.e., one molecule of chlorine gas.

At lower pH levels, aqueous solutions formed by dissolving hypochlorite-yielding compounds contain active chlorine, partially in the form of hypochlorous acid moieties and partially in the form of hypochlorite ions. At pH levels above about 10, i.e., at the pH levels of the instant compositions, essentially all (greater than 99%) of the active chlorine is reported to be in the form of hypochlorite ion.

Those bleaching agents which yield a hypochlorite species in aqueous solution include alkali metal and alkaline earth metal hypochlorites, hypochlorite addition products, chloramines, chlorimines, chloramides, and chlorimides. Specific examples of compounds of this type include sodium hypochlorite, potassium hypochlorite, monobasic calcium hypochlorite, dibasic magnesium hypochlorite, chlorinated trisodium phosphate dodecahydrate, potassium dichloroisocyanurate, sodium dichloroisocyanurate, sodium dichloroisocyanurate dihydrate, trichlorocyanuric acid, 1,3-dichloro-5,5-dimethylhydantoin, N-chlorosulfamide, Chloramine T, Dichloramine T, Chloramine B and Dichloramine B. A preferred bleaching agent for use in the compositions of the instant invention is sodium hypochlorite, potassium hypochlorite, or a mixture thereof.

Most of the above-described hypochlorite-yielding bleaching agents are available in solid or concentrated form and are dissolved in water during preparation of the compositions of the instant invention. Some of the above materials are available as aqueous solutions.

The above-described bleaching agents are dissolved in the aqueous liquid component of the present composition. Bleaching agents can provide from about 0.2% to about 2.5% available chlorine by weight, preferably from about 0.5% to about 1.5% available chlorine, by weight of the total composition.

Polymeric Thickening Agent

The thickening agent in the compositions of the present invention is a cross-linked polycarboxylate polymer thickening agent. This polymer preferably has a molecular weight of from about 500,000 to about 5,000,000, more preferably from about 750,000 to about 4,000,000.

The polycarboxylate polymer is preferably a carboxyvinyl polymer. Such compounds are disclosed in U.S. Pat. No. 2,798,053, issued on Jul. 2, 1957, to Brown, the specification of which is hereby incorporated by reference. Methods for making carboxyvinyl polymers are also disclosed in Brown.

A carboxyvinyl polymer is an interpolymer of a monomeric mixture comprising a monomeric olefinically unsaturated carboxylic acid, and from about 0.1% to about 10% by weight of the total monomers of a polyether of a polyhydric alcohol, which polyhydric alcohol contains at least four carbon atoms to which are attached at least three hydroxyl group, the polyether containing more than one alkenyl group per molecule. Other monoolefinic monomeric materials may be present in the monomeric mixture if desired, even in predominant proportion. Carboxyvinyl polymers are substantially insoluble in liquid, volatile organic hydrocarbons and are dimensionally stable on exposure to air.

Preferred polyhydric alcohols used to produce carboxyvinyl polymers include polyols selected from the class consisting of oligosaccarides, reduced derivatives thereof in which the carbonyl group is converted to an alcohol group, and pentaerythritol; most preferred is sucrose or pentaerythritol. It is preferred that the hydroxyl group of the modified polyol be etherified with allyl groups, the polyol having at least two allyl ether groups per polyol molecule. When the polyol is sucrose, it is preferred that the sucrose have at least about five allyl ether groups per sucrose molecule. It is preferred that the polyether of the polyol comprise from about 0.1% to about 4% of the total monomers, more preferably from about 0.2% to about 2.5%.

Preferred monomeric olefinically unsaturated carboxylic acids for use in producing carboxyvinyl polymers used herein include monomeric, polymerizable, alpha-beta monoolefinically unsaturated lower aliphatic carboxylic acids; more preferred are monomeric monoolefinic acrylic acids of the structure

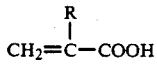

where R is a substituent selected from the group consisting of hydrogen and lower alkyl groups; most preferred is acrylic acid.

Various carboxyvinyl polymers are commercially available from B. F. Goodrich Company, New York, N.Y., under the trade name Carbopol ®. These polymers are also known as carbomers or polyacrylic acids. Carboxyvinyl polymers useful in formulations of the present invention include Carbopol 910 having a molecular weight of about 750,000, Carbopol 941 having a molecular weight of about 1,250,000, and Carbopols 934 and 940 having molecular weights of about 3,000,000 and 4,000,000, respectively.

Preferred polycarboxylate polymers of the present invention are non-linear, water-dispersible, polyacrylic acid cross-linked with a polyalkenyl polyether and having a molecular weight of from about 750,000 to about 4,000,000.

Highly preferred examples of these polycarboxylate polymers for use in the present invention are Sokalan PHC-25 ®, a polyacrylic acid available from BASF Corporation, Polygel DK available from 3-V Chemical Corporation, and the Carbopol 600 series resins available from B. F. Goodrich, especially Carbopol 614, 616 and 617. It is believed that these are more highly cross-linked than the 900 Carbopol series polymers and have molecular weights between about 1,000,000 and 4,000,000. Mixtures of polycarboxylate polymers as herein described may also be used in the present invention.

The polycarboxylate polymer thickening agent is preferably utilized with essentially no clay thickening agents since the presence of clay usually results in less desirable product having phase instability. In other words, the polycarboxylate polymer is preferably used instead of clay as a thickening agent in the present compositions.

The polycarboxylate polymer thickening agent in the compositions of the present invention is present at a level of from about 0.1% to about 10%, preferably form about 0.25% to about 5%, most preferably from about 0.5% to about 2%.

In the preferred liquid automatic dishwashing detergent composition, the polycarboxylate polymer thickening agent provides an apparent viscosity at high shear of greater than about 500 centipoise and an apparent yield value of from about 40 to about 800, and most preferably from about 60 to about 600, dynes/cm$^2$ to the composition.

The yield value is an indication of the shear stress at which the gel strength is exceeded and flow is initiated. It is measured herein with a Brookfield RVT model viscometer with a T-bar B spindle at about 77° F. (25° C.) utilizing a Helipath drive during associated readings. The system is set to 0.5 rpm and a torque reading is taken for the composition to be tested after 30 seconds or after the system is table. The system is stopped and the rpm is reset to 1.0 rpm. A torque reading it taken for the same composition after 30 seconds or after the system is stable.

Apparent viscosities are calculated from the torque readings using factors provided with the Brookfield viscometer. An apparent or Brookfield yield value is then calculated as: Brookfield Yield Value=(apparent viscosity at 0.5 rpm—apparent viscosity at 1 rpm)/100. This is the common method of calculation, published in Carbopol ® literature from the B. F. Goodrich Company and in other published references. In the cases of most of the formulations quoted herein, this apparent yield value is approximately four times higher than yield values calculated from shear rate and stress measurements in more rigorous rheological equipment.

Apparent viscosities at high shear are determined with a Brookfield RVT viscometer with spindle #6 at 100 rpm, reading the torque at 30 seconds.

Rheology Stabilizing Agent

The rheology stabilizing agents useful in the present invention have the formula:

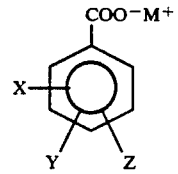

wherein each X, Y, and Z is —H, —COO$^-$M$^+$, —Cl, —Br, —SO$_3^-$M$^+$, —NO$_2$, —OCH$_3$, or a C$_1$ to C$_4$ alkyl and M is H or an alkali metal. Examples of this component include pyromellitic acid, i.e., where X, Y, and Z are $—COO^-H^+$; hemimellitic acid and trimellitic acid, i.e., where X and Y are $—COO^-H^+$ and Z is —H.

Preferred rheology stabilizing agents of the present invention are sulfophthalic acid, i.e., where X is $—SO_3^-H^+$, Y is $—COO^-H^+$, and Z is —H; other mono-substituted phthalic acids and di-substituted benzoic acids; and alkyl-, chloro-, bromo-, sulfo-, nitro-, and carboxy-benzoic acids, i.e., where Y and Z are —H and X is a $C_2$ to $C_4$ alkyl, —Cl, —Br, $—SO_3^-H^+$, $—NO_2$, and $—OCH_3$, respectively.

Highly preferred examples of the rheology stabilizing agents useful in the present invention are benzoic acid, i.e., where X, Y, and Z are —H; phthalic acid, i.e., where X is $—COO^-H^+$, and Y and Z are —H; and toluic acid, where X is $—CH_3$ and Y and Z are —H; and mixtures thereof.

All the rheology stabilizing agents described above are the acidic form of the species, i.e., M is H. It is intended that the present invention also cover the salt derivatives of these species, i.e., M is an alkali metal, preferably sodium or potassium. In fact, since the pH of compositions of the present invention are in the alkaline range, the rheology stabilizing agents exist primarily as the ionized salt in the aqueous composition herein. It is also intended the anhydrous derivatives of certain species described above be included in this invention, e.g., pyromellitic dianhydride, phthalic anhydride, sulfophthalic anhydride, etc.

Mixtures of the rheology stabilizing agents as described herein may also be used in the present invention.

This component is present in an amount of from about 0.05% to about 2%, preferably from about 0.1% to about 1.5%, most preferably from about 0.2% to about 1%, by weight, of the composition.

Cross-linked polymers, especially those of high molecular weight, as used in the present bleach-containing composition, are vulnerable to bleach-initiated degradation and result in a moss of rheology that can be unacceptable for some applications. A certain small percentage of the chlorine bleach ingredient is present in solution in the form of a free radical, i.e., a molecular fragment having one or more unpaired electrons. These radicals, although short lived, are highly reactive and may initiate the degradation of certain other species in solution, including the cross-linked polycarboxylate polymers, via propagation mechanism. The polymers of this invention are susceptible to this degradation because of the presumed oxidizable sites present in the cross-linking structure.

A small addition of the rheology stabilizing agent substantially increases the physical stability, i.e., rheological stability, of the composition of the present invention when added. Without wishing to be bound by theory, it is believed that the rheology stabilizing agent functions as a free radical scavenger, tying up the highly reactive species in the composition and preventing them from attacking the degradation-susceptible structure of the polycarboxylate polymers.

Surprisingly though, other free radical scavengers are ineffective as the rheology stabilizing agent in the present invention because they react with chlorine bleach or are unable to impede the interaction between the bleach ingredient and the polymeric thickening agent. One of the preferred rheology stabilizing agents herein is benzoic acid. Benzoates have been characterized in the art as weak radical scavengers and nearly ineffective in an alkaline medium. However, phthalic and toluic acids, which have not been characterized as radical scavengers, function effectively as a rheology stabilizing agent.

Buffering Agent

In the instant compositions, it is generally desirable to also include one or more buffering agents capable of maintaining the pH of the compositions within the alkaline range, determined as the pH of the undiluted composition ("as is") with a pH meter. It is in this pH range that optimum performance and stability of the bleach are realized, and it is also within this pH range wherein optimum composition chemical and physical stability are achieved.

Maintenance of the composition pH above about 10, preferably above about 11.5, minimizes undesirable chemical decomposition of the active chlorine, hypochlorite-yielding bleaching agents. Maintenance of this particular pH range also minimizes the chemical interaction between the strong hypochlorite bleach and the surfactant compounds present in the instant compositions. Finally, as noted, high pH values such as those maintained by an optional buffering agent serve to enhance the soil and stain removal properties during utilization of the present compositions.

Any compatible material or mixture of materials which has the effect of maintaining the composition pH within the alkaline pH range, and preferably within a 10 to about 13 range, can be utilized as the buffering agent in the instant invention. Such materials can include, for example, various water-soluble, inorganic salts such as the carbonates, bicarbonates, sesquicarbonates, silicates, pyrophosphates, phosphates, tetraborates, and mixtures thereof. Examples of material which can be used either alone or in combination as the buffering agent herein include sodium carbonate, sodium bicarbonate potassium carbonate, sodium sesquicarbonate, sodium silicate, potassium silicate, sodium pyrophosphate, tetrapotassium pyrophosphate, tripotassium phosphate, trisodium phosphate, anhydrous sodium tetraborate, sodium tetraborate pentahydrate, potassium hydroxide, sodium hydroxide, and sodium tetraborate decahydrate. Combination of these buffering agents, which include both the sodium and potassium salts, may be used. This may include mixtures of tetrapotassium pyrophosphate and trisodium phosphate in a pyrophosphate/phosphate weight ratio of about 3:1, mixture of tetrapotassium pyrophosphate and tripotassium phosphate in a pyrophosphate/phosphate weight ratio of about 3:1, and mixtures of anhydrous sodium carbonate and sodium silicate in a carbonate/silicate weight ratio of about 1:3 to about 3:1, preferably from about 1:2 to about 2:1.

If present, the above-described buffering agent materials are dissolved or suspended in the aqueous liquid component. Buffering agents can generally comprise from 1% to about 25% by weight, preferably from about 2.5% to about 20% by weight, of the total composition.

Detergent Surfactants

The compositions of this invention can contain from 0% to about 5%, preferably from about 0.1% to about 2.5%, of a bleach-stable detergent surfactant.

Desirable detergent surfactants, in general, include nonionic detergent surfactants, anionic detergent surfactants, amphoteric and zwitterionic detergent surfactants, and mixtures thereof.

Examples of nonionic surfactants include:

(1) The condensation product of 1 mole of a saturated or unsaturated, straight or branched chain, alcohol or fatty acid containing from about 10 to about 20 carbon atoms with from about 4 to about 50 moles of ethylene oxide. Specific examples of such compounds include a condensation product of 1 mole of coconut fatty acid or tallow fatty acid with 10 moles of ethylene oxide; the condensation of 1 mole of oleic acid with 9 moles of ethylene oxide; the condensation product of 1 mole of stearic acid with 25 moles of ethylene oxide; the condensation product of 1 mole of tallow fatty alcohols with about 9 moles of ethylene oxide; the condensation product of 1 mole of oleyl alcohol with 10 moles of ethylene oxide; the condensation product of 1 mole of $C_{19}$ alcohol and 8 moles ethylene oxide; and the condensation product of one mole of $C_{18}$ alcohol and 9 moles of ethylene oxide.

The condensation product of a fatty alcohol containing from 17 to 19 carbon atoms, with from about 6 to about 15 moles, preferably 7 to 12 moles, most preferably 9 moles, of ethylene oxide provides superior spotting and filming performance. More particularly, it is desirable that the fatty alcohol contain 18 carbon atoms and be condensed with from about 7.5 to about 12, preferably about 9, moles of ethylene oxide. These various specific $C_{17}$–$C_{19}$ ethoxylates give extremely good performance even at lower levels (e.g., 2.5%–3%) and at the higher levels (less than 5%) are sufficiently low sudsing, especially when capped with a low molecular weight ($C_{1-5}$) acid or alcohol moiety, so as to minimize or eliminate the need for a suds-suppressing agent. Suds-supressing agents in general tend to act as a load on the composition and to hurt long term spotting and filing characteristics.

(2) Polyethylene glycols or polypropylene glycols having molecular weight of from about 1,400 to about 30,000, e.g., 20,000; 9,500; 7,500; 6,000; 4,500; 3,400; and 1,450. All of these materials are wax-like solids which melt between 110° F. (43° C.) and 200° F. (93° C.).

(3) The condensation products of 1 mole of alkyl phenol wherein the alkyl chain contains from about 8 to about 18 carbon atoms and from about 4 to about 50 moles of ethylene oxide. Specific examples of these nonionics are the condensation products of 1 mole of decylphenol with 40 moles of ethylene oxide; the condensation product of 1 mole of dodecyl phenol with 35 moles of ethylene oxide; the condensation product of 1 mole of tetradecylphenol with 25 moles of ethylene oxide; the condensation product of 1 mole of hectadecylphenol with 30 moles of ethylene oxide, etc.

(4) Polyoxypropylene, polyoxyethylene condensates having the formula $HO(C_2H_4O)_x(C_3H_6O)_y(C_2H_4O)_xH$ or $HO(C_3H_6O)_y(C_2H_4O)_x(C_3H_6O)_yH$ where total y equals at least 15 and total $(C_2H_4O)$ equals 20% to 90% of the total weight of the compound and the molecular weight is from about 2,000 to about 10,000, preferably from about 3,000 to about 6,000. These materials are, for example, the Pluronics which are well known in the art.

(5) The compounds of (1) or (4) which are capped with propylene oxide, butylene oxide and/or short chain alcohols and/or short chain fatty acids, e.g., those containing from 1 to about 5 carbon atoms, and mixtures thereof.

Useful surfactants in detergent compositions are those having the formula $RO—(C_2H_4O)_xR^1$ where R is an alkyl or alkylene group containing from 17 to 19 carbon atoms, x is a number from about 6 to about 15, preferably from about 7 to about 12, and $R^1$ is selected from the group consisting of: preferably, hydrogen, $C_{1-5}$ alkyl groups, $C_{2-5}$ acyl groups and groups having the formula $—(C_yH_{2y}O)_nH$ wherein y is 3 or 4 and n is a number from one to about 4.

Particularly suitable surfactants are the low-sudsing compounds of (4), the other compounds of (5), and the $C_{17-19}$ materials of (1) which have a narrow ethoxy distribution.

In addition to the above mentioned surfactants, other suitable surfactants for detergent compositions can be found in the disclosures of U.S. Pat. Nos. 3,544,473, 3,630,923, 3,888,781 and 4,001,132, all of which are incorporated herein by reference.

Some of the aforementioned surfactants are bleach-stable but some are not. When the composition contains a hypochlorite bleach it is preferable that the detergent surfactant is bleach-stable. Such surfactants desirably do not contain functions such as unsaturation and some aromatic, amide, aldehydic, methyl keto or hydroxyl groups which are susceptible to oxidation by the hypochlorite.

Bleach-stable anionic surfactants which are especially resistant to hypochlorite oxidation fall into two main groups. One such class of bleach-stable anionic surfactants are the water-soluble alkyl sulfates and/or sulfonates, containing from about 8 to 18 carbons atoms in the alkyl group. Alkyl sulfates are the water-soluble salts of sulfated fatty alcohols. They are produced from natural or synthetic fatty alcohols containing from about 8 to 18 carbon atoms. Natural fatty alcohols include those produced by reducing the glycerides of naturally occurring fats and oils. Fatty alcohols can be produced synthetically, for example, by the Oxo process. Examples of suitable alcohols which can be employed in alkyl sulfate manufacture include decyl, lauryl, myristyl, palmityl and stearyl alcohols and the mixtures of fatty alcohols derived by reducing the glycerides of tallow and coconut oil.

Specific examples of alkyl sulfate salts which can be employed in the instant detergent compositions include sodium lauryl alkyl sulfate, sodium stearyl alkyl sulfate, sodium palmityl alkyl sulfate, sodium decyl sulfate, sodium myristyl alkyl sulfate, potassium lauryl alkyl sulfate, potassium stearyl alkyl sulfate, potassium decyl sulfate, potassium palmityl alkyl sulfate, potassium myristyl alkyl sulfate, sodium dodecyl sulfate, potassium dodecyl sulfate, potassium tallow alkyl sulfate, sodium tallow alkyl sulfate, sodium coconut alkyl sulfate, magnesium coconut alkyl sulfate, calcium coconut alkyl sulfate, potassium coconut alkyl sulfate and mixtures of these surfactants. Highly preferred alkyl sulfates are sodium coconut alkyl sulfate, potassium coconut alkyl sulfate, potassium lauryl alkyl sulfate and sodium lauryl alkyl sulfate.

A preferred sulfonated anionic surfactant is the alkali metal salt of secondary alkane sulfonates, an example of which is the Hostapur SAS from Hoechst Celanese.

A second class of bleach-stable surfactant materials operable in the instant invention are the water-soluble betaine surfactants. These materials have the general formula:

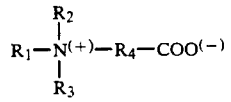

wherein $R_1$ is an alkyl group containing from 8 to 18 carbon atoms; $R_2$ and $R_3$ are each lower alkyl groups containing from about 1 to 4 carbon atoms, and $R_4$ is an alkylene group selected from the group consisting of methylene, propylene, butylene and pentylene. (Propionate betaines decompose in aqueous solution and hence are not included in the instant compositions).

Examples of suitable betaine compounds of this type include dodecyldimethylammonium acetate, tetradecyldimethylammonium acetate, hexadecyldimethylammonium acetate, alkyldimethylammonium acetate wherein the alkyl group averages about 14.8 carbon atoms in length, dodecyldimethylammonium butanoate, tetradecyldimethylammonium butanoate, hexadecyldimethylammonium butanoate, dodecyldimethylammonium hexanoate, hexadecyldimethylammonium hexanoate, tetradecyldiethylammonium pentanotate and tetradecyldipropyl ammonium pentanoate. Especially preferred betaine surfactants include dodecyldimethylammonium acetate, dodecyldimethylammonium hexanoate, hexadecyldimethylammonium acetate, and hexadecyldimethylammonium hexanoate.

Nonionic surfactants useful herein include ethoxylated and/or propoxylated nonionic surfactants such as those available from BASF Corp. of New Jersey. Examples of such compounds are polyethylene oxide, polypropylene oxide block copolymers sold under the trade names Pluronic ® and Tetronic ® available from BASF Corp.

Preferred members of this class are capped oxyalkylene oxide block copolymer surfactants of the following structure:

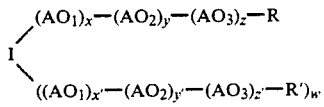

where I is the residue of a monohydroxyl, dihydroxyl, or a polyhydroxyl compound; $AO_1$, $AO_2$,a nd $AO_3$ are oxyalkyl groups and one of $AO_1$ and $AO_2$ is propylene oxide with the corresponding x or y being greater than zero, and the other of $AO_1$ and $AO_2$ is ethylene oxide with the corresponding x or y being greater than zero, and the molar ratio of propylene oxide to ethylene oxide is from about 2:1 to about 8:1; R and R′ are hydrogen, alkyl, aryl, alkyl aryl, aryl alkyl, carbamate, or butylene oxide; w is equal to zero or one; and z, x′, y′, and z′ are greater than or equal to zero.

Other bleach-stable surfactants include amine oxides, phosphine oxides, and sulfoxides. However, such surfactants are usually high sudsing. A disclosure of bleach-stable surfactants can be found in published British Patent Application 2,116,199A; U.S. Pat. No. 4,005,027, Hartman; U.S Pat. No. 4,115,851, Rupe et al; U.S. Pat. No. 3,985,668, Hartman; U.S. Pat. No. 4,271,030, Brierley et al; and U.S. Pat. No. 4,116,849, Leikhim, all of which are incorporated herein by reference.

Other desirable bleach-stable surfactants are the alkyl phosphonates, taught in U.S. Pat. No. 4,105,573, to Jacobsen, issued Aug. 8, 1978, incorporated herein by reference.

Still other preferred bleach-stable anionic surfactants include the linear or branched alkali metal mono- and-/or di-($C_{8-14}$) alkyl diphenyl oxide mono- and/or disulfonates, commercially available under the trade names Dowfax 3B-2 (sodium n-decyl diphenyloxide disulfonate) and Dowfax 2A-1. These and similar surfactants are disclosed in published U.K. Patent Applications 2,163,447A; 2,163,448A; and 2,164,350A, said applications being incorporated herein by reference.

Detergency Builder

Detergency builders are optional materials which reduce the free calcium and/or magnesium ion concentration in a surfactant-containing aqueous solution. In the preferred liquid automatic dishwashing detergent compositions they are used at a level of from about 5% to about 50%, preferably from about 15% to about 40%. Generally the detergency builder used in liquid automatic dishwashing detergent compositions like those of the present invention, is sodium tripolyphosphate in an amount from about 10% to about 40%, preferably from about 15% to about 30%.l Generally a certain percentage of the sodium tripolyphosphate is in an undissolved particulate form suspended in the rest of the detergent composition. A phosphate ester, if present in the composition, works to keep such solid particles suspended in the aqueous solution.

The detergency builder material can be any of the detergent builder materials known in the art which include trisodium phosphate, tetrasodium pyrophosphate, sodium tripolyphosphate, sodium hexametaphosphate, potassium pyrophosphate, potassium tripolyphosphate, potassium hexametaphosphate, sodium silicates having $SiO_2$:$Na_2O$ weight ratios of from about 1:1 to about 3.6:1, sodium carbonate, sodium hydroxide, borax, sodium nitrilotriacetate, sodium carboxymethyloxysuccinate, sodium carboxymethyloxymalonate, polyphosphonates, salts of low molecular weight carboxylic acids, and polycarboxylates, such as polyacrylates or polymaleates, copolymers and mixtures thereof.

Some of the above-described buffering agent materials additionally serve as builders. It is preferred that the buffering agent contain at least one compound capable of additionally acting as a builder.

Alkali Metal Amphoteric Metalate

An optional component of the present invention is an alkali metal salt of an amphoteric metal anion, hereinafter referred to as a metalate. This component can provide additional structuring to the polycarboxylate polymer thickening agent in the preferred liquid automatic dishwashing detergent composition.

The metalate in the liquid automatic dishwashing detergent compositions of the present invention is present at a level of from 0% to about 1%, preferably from about 0.01% to about 0.1%.

The metalates of amphoteric metals, e.g., aluminum, zinc, beryllium, tin, zirconium, titanium, etc., will act similarly in the present invention to provide this polymer structuring benefit. These alternative metalates are intended to be covered by the present invention. A preferred metalate is potassium or sodium aluminate, e.g., $xM_2O \cdot yAl_2O_3 \cdot zH_2O$, where M is K or Na.

One method of incorporating the metalate into the preferred liquid automatic dishwashing detergent composition is by dissolving or colloidally dispersing an amphoteric metal oxide into an aqueous alkali metal hydroxide in an amount equal to or greater than one molar equivalent of the hydroxide. Some metalates, such as sodium aluminate, are commercially available.

The metalate can be added into the composition at any point when the pH of the mixture is above 10, preferably above about 11.5. A preferred method of incorporated the metalate into the preferred liquid automatic dishwashing detergent composition is by blending the metalate into an aqueous solution of an alkali metal silicate and then incorporating the resultant colloid with other components of the liquid automatic dishwashing detergent composition. The preferred structuring benefit is seen when the metalate is finely dispersed in the silicate such that very little or no increased turbidity is visible in the mixture.

Formulation of these compositions with a metalate such as aluminate assures that cationic metal ions such as $Al^{+3}$ are not present to precipitate silicate under such mixing conditions.

The lack of suspended or visible solids in this colloidal silico-metalate, i.e., particle sizes smaller than about 1 micron, allows for the finished composition to be a clear or translucent gel when sufficient potassium salts are used to ensure dissolution of other components, i.e., molar ratio of potassium to sodium ions greater than about 1:1, preferably greater than about 3:2.

From about 0% to about 15%, preferably from about 3% to about 10%, on a solids basis, of the silico-metalate is added to the polyacrylate polymer thickening agent to get the additional structuring. The molar ratio of aluminum metal to $SiO_2$ in the preferred colloidal dispersion formed should be from about 0.01:1 to about 0.1:1, preferably from about 0.02:1 to about 0.06:1, to get the best structuring benefits.

Other Optional Materials

The compositions of the present invention may optionally comprise certain esters of phosphoric acid (phosphate ester). Phosphate esters are any materials of the general formula:

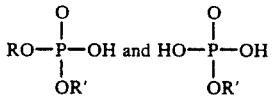

wherein R and R' are C-$C_{20}$ alkyl or ethoxylated alkyl groups. Preferably R and R' are of the general formula: alkyl-$(OCH_2CH_2)_Y$ wherein the alkyl substituent is $C_{12}$-$C_{18}$ and Y is between 0 and about 4. Most preferably the alkyl substituent of that formula is $C_{12}$-$C_{18}$ and Y is between about 2 and about 4. Such compounds are prepared by known methods from phosphorus pentoxide, phosphoric acid, or phosphorus oxy halide and alcohols or ethoxylated alcohols.

It will be appreciated that the formula depicted represent mono- and di-esters, and commercial phosphate esters will generally comprise mixtures of the mono- and di-esters, together with some proportion of tri-ester. Typical commercial esters are available under the trademarks "Phospholan" PDB3 (Diamond Shamrock), "Servoxyl" VPAZ (Servo), PCUK-PAE (BASF-Wyandotte), SAPC (Hooker). Preferred for use in the present invention are KN340N and KL340N (Hoescht) and monostearyl acid phosphate (Oxidental Chemical Corp.). Most preferred for use in the present invention s Hostophat-TP-2253 (Hoescht).

The phosphate esters useful herein provide protection of silver and silver-plated utensil surfaces. The phosphate ester component also acts as a suds suppressor in the anionic surfactant-containing detergent compositions disclosed herein.

If a phosphate ester component is used in the compositions of the present invention, it is generally present from about 0.1% to about 5%, preferably from about 0.15% to about 1.0% by weight of the composition.

Metal salts of long chain hydroxy fatty acids have been found to be useful in automatic dishwashing detergent compositions to inhibit tarnishing caused by repeated exposure of sterling or silver-plate flatware to bleach-containing automatic dishwashing detergent compositions (U.S. Pat. No. 4,859,358, Gabriel et al). By "long chain hydroxy fatty acid" is meant the higher aliphatic hydroxy fatty acids having from about 8 to about 22 carbon atoms, preferably from about 10 to 20 carbon atoms, and most preferably from about 12 to 18 carbon atoms, inclusive of the carbon atom of carboxyl group of the fatty acid, e.g., hydroxy stearic acid. By "metal salts" of the long chain hydroxy fatty acids is meant both monovalent and polyvalent metal salts, particularly the sodium, potassium, lithium, aluminum, and zinc salts, e.g., lithium salts of the hydroxy fatty acids. Specific examples of this material are potassium, sodium, and particularly lithium hydroxy stearate. If the metal salts of long chain hydroxy fatty acids are incorporated into the automatic dishwashing detergent compositions of the present invention, this component generally comprises from about 0.05% to about 0.3%, preferably from about 0.05% to about 0.2% by weight of the composition.

Conventional coloring agents and perfumes can also be added to the instant compositions to enhance their aesthetic appeal and/or consumer acceptability. These materials should, of course, be those dye and perfume varieties which are especially stable against degradation by high pH and/or strong active chlorine bleaching agents.

If present, the above-described other optional materials generally comprise no more than about 10% by weight of the total composition and are dissolved, suspended, or emulsified in the present compositions.

As used herein all percentages, parts, and ratios are by weight unless otherwise stated.

The following Examples illustrate the invention and facilitate its understanding.

Example I

A liquid automatic dishwashing detergent composition of the present invention is as follows:

| Ingredient | % By Weight |
|---|---|
| Sodium tripolyphosphate (STPP) | 4.67 |
| Tetrapotassium pyrophosphate (TKPP) | 12.60 |
| Sodium silicate, 2.4 ratio | 3.27 |
| Potassium carbonate ($K_2CO3$) | 3.91 |
| Sodium carbonate ($Na_2CO3$) | 2.61 |
| Available chlorine (added as NaOCl) | 0.93 |
| Potassium hydroxide (KOH) | 0.84 |
| Monostearyl acid phosphate (MSAP) | 0.03 |
| Polyacrylic acid (Sokalan PHC-25) | 1.07 |
| $Al_2O3$ (added as sodium aluminate) | 0.03 |
| Rheology stabilizing agent (if added) | 0.47 |
| Trim KOH, to pH 12.2–12.3 | 0–0.3 |

-continued

| Ingredient | % By Weight |
|---|---|
| Perfume, dye, water | Balance to 100 |

The polyacrylic acid is slurried into demineralized water at 3.4% by weight. All other ingredient are added in the following order while stirring with a paddle blade mixer: additional available trim water, TKPP as a 40% aqueous solution, sodium aluminate (nominally 46.8% $Al_2O_3$) about 5% in water, and KOH (45% in water added before, or premixed with, the colloidal aluminate dispersion), silicate as 47.3% solids in water, sodium and potassium carbonates and STPP as dry powders (essentially dissolved within five minutes), a heated 2.6% aqueous dispersion of MSAP suds suppressant, the rheology stabilizing agent. The acids or anhydrides are neutralized by the excess caustic already present in the composition. Heat is added during mixing up to this point so that the mixture temperature is above about 130° F. (54° C.). This temperature is maintained at least five minutes to aid in sample equilibration. After the composition has cooled to about 90° F. (32° C.) or below, the aqueous sodium hypochlorite is added as approximately 13% available chlorine. Optional perfume and colorants are added last. The composition is clear or translucent, with no visible particles or turbidity. Balance water is added, along with sufficient KOH trim to adjust the pH of the composition "as is" to 12.2–12.3, and further KOH trim is used if needed after overnight equilibration.

After about one to three days of equilibration, samples of the above composition exhibit an apparent Brookfield yield volume of about 250 to 450 dynes/cm$^2$, an apparent viscosity at high shear (100 rpm, Brookfield RVT #6) of about 1300 to 2000 cps, and an apparent viscosity at moderate shear (20 rpm, Brookfield RVT #6) of about 4000 to 7000 cps.

Physical properties are recorded, and light-shielded bottled samples are placed in 100° F. (38° C.) and 120° F. (49° C.) and at ambient conditions. Brookfield apparent viscosities are determined with a Brookfield RVT model with #6 spindle at 100 RPM. In the rapid aging condition of 120° F. (49° C.), the following viscosity readings are taken at one-week intervals. The day following the making of the composition is the initial day.

| Rheology Stabilizing Agent | Initial Viscosity (Centipoise) | % of Initial Viscosity After: 1 Week | 2 Weeks | 3 Weeks | 4 Weeks | 6 Weeks |
|---|---|---|---|---|---|---|
| None | 1900 | 112% | 14% | — | | |
| Benzoic acid | 1760 | 114% | 111% | 122% | 101% | 69% |
| Phthalic anhydride | 1380 | 180% | 178% | 152% | 107% | 22% |
| Pyromellitic anhydride | 1750 | 94% | 74% | 32% | — | |
| Mellitic anhydride | 1600 | 153% | 41% | — | | |

It is seen that a benzene ring with one or two carboxylic acid groups can more than double the rheological life of the above composition under such storage conditions. Apparently four carboxyl functions on the ring exhibit reduced benefit, and more than four carboxyls result in essentially no stability benefit. Note that viscosity usually increases in the early weeks and is believed to be due to continuing polymer swelling by caustic and bleach.

The addition of benzoic acid or substituted benzoic acids usually results in an initial lower viscosity compared to the no additive formula, but a dramatically improved storage stable formula is achieved.

Example II

Benzoic acid and the benzoate salts are identified in published literature as potential free radical scavengers. Other liquid automatic dishwashing detergent compositions using known free radical scavengers are prepared approximately according to the method described in the preceding Example. With the addition of benzoic acid or benzoate salt, the available chlorine decays at about the same rate or slower, compared to the no-additive control. Most other free radical scavengers degrade the activity of the hypochlorite bleach when placed in storage tests in the formula context of the previous example.

| Rheology Stabilizing Agent | Level | % of Initial Value Remaining: Viscosity 2 Weeks | Viscosity 3 Weeks | Av. Chlorine 2 Weeks | Av. Chlorine 3 Weeks |
|---|---|---|---|---|---|
| None | — | 14% | — | 49% | — |
| Benzoic acid | 0.47% | 111% | 122% | 65% | 48% |
| Sodium benzoate | 0.56% | 131% | 122% | 56% | 46% |
| Phytic acid | 0.47% | 14% | — | 45% | — |
| Ascorbic acid | 0.47% | not read | — | 0% | — |
| Dilauryl thiodipropionate | 0.47% | 5% | — | 0% | — |

As seen from the above examples, most free radical scavengers either are reducing agents (reactive to available chlorine) or have chemical structures reactive to hypochlorite. Even phytic acid, said to be a hydroxyl radical scavenger in the same sense as benzoic acid, is not readily reactive with the hypochlorite, but it does not exhibit the rheology stabilization of the benzoic acid or sodium benzoate.

Example III

Various levels of benzoic acid (prospective rheology stabilizing agent) are tested following the method of preparation in Example I. Also, these samples are screened in the rapid aging stability test as described above. Viscosity stability as a function of storage time is shown:

| Benzoic Acid Level | Initial Viscosity (Centipoise) | % of Initial Viscosity After: 1 Week | 2 Weeks | 3 Weeks | 4 Weeks | 6 Weeks |
|---|---|---|---|---|---|---|
| None | 1900 | 112% | 14% | ** | | |
| 0.1% | 3540* | 108% | 92% | 14% | ** | |
| 0.2% | 1830 | 107% | 113% | 91% | 66% | ** |
| 0 5% | 1760 | 114% | 111% | 122% | 101% | 69% |
| 0.7% | 1300 | 145% | 101% | 84% | 68% | 94% |
| 1.0% | 1430 | 130% | 134% | 158 | 122% | 105% |

*This sample only at 1.21% polyacrylic acid vs. 1.07% in other samples.
**Measured below 10% of initial viscosity, or approaching water-thin by appearance.

The degree of increased rheological stability desired in a composition can be achieved by adjustment of the level of benzoate compound added to the formulation, realizing that higher levels can adversely affect initial composition viscosity.

Example IV

The following liquid automatic dishwashing detergent composition are as follows:

| Ingredient | % By Weight Composition A-1 | A-2 | B-1 | B-2 |
|---|---|---|---|---|
| Sodium tripolyphosphate (STPP) | 4.67 | 4.67 | 4.67 | 4.67 |
| Tetrapotassium pyrophohphate (TKPP) | 12.60 | 12.60 | 12.60 | 12.60 |
| Sodium silicate, 2.4 ratio | 6.54 | 6.54 | 3.27 | 3.27 |
| Potassium carbonate ($K_2CO3$) | 4.92 | 4.92 | 3.91 | 3.91 |
| Sodium carbonate ($Na_2CO3$) | 1.84 | 1.84 | 2.61 | 2.61 |
| Available chlorine (added as NaOCl) | 0.93 | 0.93 | 0.93 | 0.93 |
| Potassium hydroxide (KOH) | 0.84 | 0.84 | 0.84 | 0.84 |
| Polyacrylic acid (Sokalan PHC-25) | 1.07 | 1.07 | 1.31 | 1.31 |
| $ZnO_2$ (added as potassium zincate) | 0.03 | 0.03 | 0 | 0 |
| Benzoic acid | 0 | 0.47 | 0 | 0.47 |
| Trim KOH, to pH below | 0–0.3 | 0–0.3 | 0–0.3 | 0–0.3 |
| Perfume, dye, trim water to 100% | Balance to 100% | | | |
| | A | | B | |
| Neat pH of Compositions | 12.5–12.6 | | 12.2–12.3 | |

A storage test as described in Example I is set up with the formulations. Viscosity stability as a function of time in 120° F. (49° C.) is summarized.

| Composition | Initial Viscosity (Centipoise) | % of Initial Viscosity After: 1 Week | 2 Weeks | 3 Weeks | 4 Weeks |
|---|---|---|---|---|---|
| A-1 | 1380 | 130% | 36% | * | * |
| A-2 | 1480 | 121% | 105% | 95% | 100% |
| B-1 | 2960 | 90% | * | | |

-continued

| Composition | Initial Viscosity (Centipoise) | % of Initial Viscosity After: 1 Week | 2 Weeks | 3 Weeks | 4 Weeks |
|---|---|---|---|---|---|
| B-2 | 4320 | 114% | 87% | 88% | 72% |

*Measured viscosity below 10% of initial, or approaching water-thin by appearance.

The addition of benzoic acid to the A-1 and B-1 compositions results in dramatic increase in rheological stability of the A-2 and B-2 compositions under the stress test conditions.

Example V

Substituted benzoic acids are placed into the compositions of Example I (less the MSAP) as candidate rheology stabilizers and are subjected to the same stress stability testing in light-shielded bottles at 120° F. (49° C.).

| Rheology Stabilizing Agent | Level | % of Initial Remaining: Viscosity 2 Weeks | Viscosity 3 Weeks | Av. Chlorine 2 Weeks | Av. Chlorine 3 Weeks |
|---|---|---|---|---|---|
| Salicyclic acid | 0.47% | Not read | * | 0% | * |
| 5-sulfosalicylic acid | 0.47% | Not read | * | 0% | * |
| m-hydroxybenzoic acid | 0.47% | Not read | * | 0% | * |
| o-chlorobenzoic acid | 0.47% | 210% | 108% | 60% | 49% |
| m-chlorobenzoic acid | 0.47% | 80% | 96% | 56% | 46% |
| p-chlorobenzoic acid | 0.47% | 154% | 107% | 66% | 55% |
| m-sulfobenzoic acid, monosodium salt | 0.47% | 162% | 33% | 59% | 47% |
| m-toluic acid | 0.47% | 88% | 109% | 58% | 47% |
| p-toluic acid | 0.47% | 124% | 134% | 61% | 53% |
| p-nitrobenzoic acid | 0.47% | 117% | <40% | 52% | 44% |
| 4-sulfophthalic acid | 0.47% | 175% | <40% | 54% | 45% |

*Denotes a sample no longer monitored, due to very low previous readings.

All the above mono-substituted benzoic acids (except ones with a hydroxyl substituent) are effective at increasing the rheological stability of the composition substantially beyond that given by compositions with no rheology stabilizing agent (see Examples I–III). Readings below about 80% of initial viscosity can be considered to reflect a noteworthy drop in viscosity for purposes of this test (since Brookfield viscosity values with thick compositions of this type have considerable variability).

The hydroxybenzoic samples lose all available chlorine by day one, so no viscosity readings are considered relevant beyond that point.

The successful viscosity stabilization with the 4-sulfophthalic acid and failure by the 5-sulfosalicyclic acid indicate that the di-substituted benzoic acids, or mono-substituted phthalic acids, follow the same pattern.

Of the above compositions, only those containing toluic acids and m-chlorobenzoic are above 80% of initial viscosity at four weeks, and only the one with m-toluic acid is still above 80% at six weeks. Thus, toluic acid is a preferred rheology stabilizer, and it appears that a meta isomer may be a preferred positional configuration.

Example VI

Liquid cleaning compositions of the present invention are as follows;

| Ingredient | Formula Parts, % of Active Ingredient | | | | | |
|---|---|---|---|---|---|---|
| | A-1 | A-2 | B-1 | B-2 | C-1 | C-2 |
| Sodium silicate solids, 2.4 ratio | 2.50 | 2.50 | 2.50 | 2.50 | 2.50 | 2.50 |
| Available chlorine (added as NaOCl) | 1.00 | 1.00 | 1.00 | 1.00 | 1.00 | 1.00 |
| KOH trim to pH shown below | 0–2 | 0–2 | 0–2 | 0–2 | 0–2 | 0–2 |
| Acetic acid, glacial | 0 | 0 | 0 | 0 | 0.50 | 0.50 |
| Polyacrylic acid (Sokalan PH25) | 1.30 | 1.30 | 1.25 | 1.25 | 1.00 | 1.00 |
| Benzoic acid (stabilizing agent) | 0 | 0.50 | 0 | 0.50 | 0 | 0.50 |
| Water | Balance to 100 | | | | | |
| Composition pH, measured as-is | 12.0 | 12.0 | 11.0 | 11.0 | 10.3 | 10.3 |
| Initial apparent viscosity, cps | 1410 | 1070 | 1400 | 1220 | 4290 | 5680 |
| Initial apparent yield value, dynes/cm$^2$ | 72 | 88 | 108 | 88 | * | * |

*Note: The C-1 and C-2 compositions are so highly structured due to the reduced pH that syneresis (clear phase separation) prevents accurate measurement of yield value.

All of the above compositions are clear to translucent gels and are useful for hard surface cleaning and similar applications. The compositions containing benzoic acid as a rheology stabilizing agent are able to retain viscosity and yield value (80% of initial values or higher) for a longer time under stress storage than the compositions without the stabilizing agent. Benzoic acid and other rheology stabilizing agents of the invention result in a lower initial viscosity as indicated above, but the stabilization effect over time more than compensates for a lower initial viscosity.

What is claimed is:

1. A liquid cleaning composition comprising, by weight:

(a) a chlorine bleach ingredient providing from about 0.2% to about 2.5% available chlorine;

(b) from about 0.1% to about 10% of a cross-linked polycarboxylate polymer thickening agent;

(c) from about 0.05% to about 5% of a rheology stabilizing agent having the formula

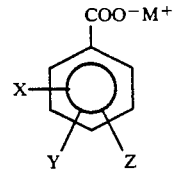

wherein each X, Y and Z is selected from the group consisting of —H, —COO⁻M⁺, —Cl, —Br, —$SO_3^-M^+$, —$NO_2$, —$OCH_3$, or a $C_1$ to $C_4$ alkyl and M is H or an alkali metal; or mixtures thereof; and (d) sufficient alkalinity buffering agent to provide said composition with a pH greater than about 10.

2. The composition of claim 1 wherein the composition is an automatic dishwashing detergent composition further comprising:

(a) from 0% to about 5% of a detergent surfactant; and (b) from about 5% to about 50% of a detergency builder material.

3. The composition of claim 2 further comprising from 0% to about 1% of an alkali metal salt of an amphoteric metal anion; said composition having an apparent yield value of from about 40 to about 800 dynes/cm$^2$.

4. The composition of claim 2 wherein the chlorine bleach ingredient is selected from the group consisting of sodium hypochlorite, potassium hypochlorite, and mixtures thereof.

5. The composition of claim 1 comprising the chlorine bleach ingredient providing from about 0.5% to about 1.5% available chlorine based on the weight of the composition.

6. The composition of claim 4 comprising the chlorine bleach ingredient providing from about 0.5% to about 1.5% available chlorine based on the weight of the composition.

7. The composition of claim 1 wherein the molecular weight of the polycarboxylate polymer thickening agent is from about 750,000% to 4,000,000.

8. The composition of claim 1 comprising from about 0.25% to about 5% of the polycarboxylate polymer thickening agent.

9. The composition of claim 7 comprising from about 0.5% to about 2% of the polycarboxylate polymer thickening agent.

10. The composition of claim 8 comprising from about 0.5% to about 2% of the polycarboxylate polymer thickening agent.

11. The composition of claim 1 wherein Z in the rheology stabilizing agent is H.

12. The composition of claim 11 wherein the rheology stabilizing agent is selected from the group consisting of benzoic acid, phthalic acid, toluic acid and salts and mixtures thereof.

13. The composition of claim 1 comprising from about 0.1% to about 2% of the rheology stabilizing agent.

14. The composition of claim 1 comprising from about 0.2% to about 1% of the rheology stabilizing agent.

15. The composition of claim 13 comprising from about 0.2% to about 1% of the rheology stabilizing agent.

16. The composition of claim 1 wherein the alkalinity buffering agent is selected from the group consisting of alkali metal silicates, alkali metal carbonates, alkali metal hydroxides, and mixtures thereof.

17. The composition of claim 1 comprising sufficient alkalinity buffering agent to provide the composition with a pH greater than about 11.5.

18. The composition of claim 16 comprising sufficient alkalinity buffering agent to provide the composition with a pH greater than about 11.5.

19. The composition of claim 2 wherein the surfactant is selected from the group consisting of capped propylene oxide, ethylene oxide block copolymers; condensation products of ethylene oxide and propylene oxide with a mono-, di-, or poly-hydroxyl compound with residual hydroxyls capped; alkali metal salts of mono- and/or di-($C_{8-14}$) alkyl diphenyl oxide mono- and/or di-sulfonates; $C_{8-18}$ alkyl sulfates; $C_{8-18}$ alkyl sulfonates; and mixtures thereof.

20. The composition of claim 2 comprising from about 0.1% to about 2.5% of the surfactant.

21. The composition of claim 19 comprising from about 0.1% to about 2.5% of the surfactant.

22. The composition of claim 2 wherein the builder is selected from the group consisting of alkali metal tripolyphosphate, alkali metal pyrophosphate, alkali metal silicates, alkali metal carbonates, polycarboxylates, and mixtures thereof.

23. The composition of claim 2 comprising from about 15% to about 40% of the builder.

24. The composition of claim 22 comprising from about 15% to about 40% of the builder.

25. The composition of claim 3 wherein the alkali metal salt of an amphoteric metal anion is selected from the group consisting of sodium and potassium aluminate, sodium and potassium zincate, sodium and potassium stannate (IV), sodium and potassium titanate (IV), and mixtures thereof.

26. The composition of claim 3 comprising from about 0.01% to about 0.1% of the alkali metal salt of an amphoteric metal anion.

27. The composition of claim 25 comprising from about 0.01% to about 0.1% of the alkali metal salt of an amphoteric metal anion.

28. The composition of claim 19 wherein the builder is selected from the group consisting of alkali metal tripolyphosphate, alkali metal pyrophosphate, alkali metal silicates, alkali metal carbonates, polycarboxylates, and mixtures thereof, and the chlorine bleach ingredient is selected from the group consisting of sodium hypochlorite, potassium hypochlorite, and mixtures thereof.

29. The composition of claim 28 wherein the molecular weight of the polycarboxylate polymer thickening agent is from about 750,000 to 4,000,000, and the rheology stabilizing agent is selected from the group consisting of benzoic acid, phthalic acid, toluic acid, and salts, and mixtures thereof.

30. The composition of claim 29 wherein the alkalinity buffering agent is selected from the group consisting of alkali metal silicates, alkali metal carbonates, alkali metal hydroxides, and mixtures thereof, and the composition has a pH greater than about 11.5.

31. The composition of claim 30 comprising, by weight:

the chlorine bleach ingredient providing from about 0.5% to about 1.5% available chlorine;

(b) from about 0.5% to about 2% of the cross-linked polycarboxylate polymer thickening agent;

(c) from about 0.2% to about 1% of the rheology stabilizing agent;

(d) from about 0.1% to about 2.5% of the surfactant; and (e) from about 15% to about 40% of the builder.

32. The composition of claim 30 further comprising an alkali metal salt of an amphoteric metal anion selected from the group consisting of sodium and potassium aluminate, sodium and potassium zincate, sodium and potassium stannate (IV), sodium and potassium titanate (IV) and mixtures thereof.

33. The composition of claim 32 comprising from about 0.01% to about 0.1% of the alkali metal salt of an amphoteric metal ion.

* * * * *